US011737577B1

(12) United States Patent
Liu

(10) Patent No.: US 11,737,577 B1
(45) Date of Patent: Aug. 29, 2023

(54) FACE CUSHION

(71) Applicant: PEGASUS MEDICAL SUPPLY, INC., New Taipei (TW)

(72) Inventor: Tsung-Hsuan Liu, Taipei (TW)

(73) Assignee: PEGASUS MEDICAL SUPPLY, INC., New Taipei (TW)

( * ) Notice: Subject to any disclaimer, the term of this patent is extended or adjusted under 35 U.S.C. 154(b) by 0 days.

(21) Appl. No.: 17/687,096

(22) Filed: Mar. 4, 2022

(51) Int. Cl.

| | |
|---|---|
| ***A47C 27/08*** | (2006.01) |
| ***A47C 7/38*** | (2006.01) |
| ***A61G 7/07*** | (2006.01) |
| ***A61G 13/12*** | (2006.01) |
| ***A47G 9/10*** | (2006.01) |

(52) U.S. Cl.
CPC ..... *A47C 27/081* (2013.01); *A47C 7/383* (2013.01); *A47G 9/1027* (2013.01); *A61G 7/072* (2013.01); *A61G 13/121* (2013.01); *A47G 9/1054* (2013.01); *A61G 2200/325* (2013.01)

(58) Field of Classification Search
CPC ..... A47C 27/081; A47C 27/082; A47C 7/38; A47C 7/383; A61G 7/072; A61G 13/121; A61G 2200/325; A47G 9/10; A47G 9/1027; A47G 9/1054
USPC ..... 5/644, 638, 636, 622
See application file for complete search history.

(56) References Cited

U.S. PATENT DOCUMENTS 4,752,064 A * 6/1988 Voss ..... A61G 13/0054 5/636
D298,992 S * 12/1988 Voss ..... D6/601
D337,914 S * 8/1993 McDonald ..... D6/601
5,960,494 A * 10/1999 Gilliland ..... A61G 13/0081 5/713
D456,516 S * 4/2002 Cheshaek ..... D24/183
6,637,058 B1 * 10/2003 Lamb ..... A61G 13/12 5/636
7,146,664 B1 * 12/2006 Grosvenor ..... A61G 13/12 5/644
7,225,486 B2 * 6/2007 Jackson, III ..... A61G 5/1043 5/653
7,444,698 B2 * 11/2008 Jackson, III ..... A47G 9/1027 5/644
D625,420 S * 10/2010 Sharps ..... D6/601
2006/0150336 A1 * 7/2006 Jackson, III ..... A47G 9/1054 5/644
2006/0150338 A1 * 7/2006 Jackson, III ..... A61G 5/1043 5/655.3

(Continued)

*Primary Examiner* — Robert G Santos
(74) *Attorney, Agent, or Firm* — Rabin & Berdo, P.C.

(57) ABSTRACT

A face cushion includes a hollow-out portion located at a central portion of the face cushion; an inflatable portion having an inner peripheral edge located adjacent to the hollow-out portion, an outer peripheral edge, and two slit edges located between the inner and the outer peripheral edge, with an area between the inner and the outer peripheral edge being divided into a first and a second air bag; a slit section formed between the two slit edges; and a plurality of inflating connections separately connected to the first and the second air bag. The first and the second air bag are inflated alternately with gas supplied from a gas supply device to the inflatable body via different pipelines at different time points to produce on the face cushion a facial configuration similar to a patient's face, allowing different parts of the patient's face to contact with the face cushion intermittently.

15 Claims, 12 Drawing Sheets

(56) References Cited

U.S. PATENT DOCUMENTS

2007/0157391 A1* 7/2007 Jackson, III ..... A61G 13/0054
5/713

* cited by examiner

FACE CUSHION

FIELD OF THE INVENTION

The present invention relates to a face cushion that can be inflated with gas supplied from a gas supply device into the face cushion alternately; and more particularly, to an inflatable face cushion that allows different parts of a patient's face to contact with the face cushion intermittently.

BACKGROUND OF THE INVENTION

When a doctor in a hospital performs a surgical operation or a health examination on a patient, the patient might have to lie on a medical treatment table in a prone position. In this case, the patient's nose and forehead would be in direct contact with a hard headrest of the medical treatment table for a period of time. At this point, the patient' face is pressed against the headrest to cause discomfort or even difficulty in breath.

In the market, there is a medical treatment table having a face hole formed on the headrest for receiving the patient's face therein, so that the patient's nose located in the face hole is in a suspended state without contacting with the medical treatment table. While the face hole allows the patient in the prone position to breath smoothly without suffering from an uncomfortably pressed nose, areas surrounding the face hole of the medical treatment table could not be lifted or lowered to adjust the patient's entire face to a desired height position or to adjust a left side and a right side of the patient's face to different height positions. That is, the patient's face set in the conventional face hole is not turnable leftward or rightward.

In the case the patient is wearing a medical oxygen mask with tubing, the patient needs to remove the medical oxygen mask and the tubing thereof before he can lie on the medical treatment table in the prone position. This is because the medical treatment table is not provided with any passage communicable with the face hole for the medical oxygen mask and the tubing thereof to pass therethrough and move into the face hole. After the patient has lain on the medical treatment table in the prone position with his face set in the face hole, the previously removed medical oxygen mask is then put on the patient's face again. The repeated movements of removing and wearing the medical oxygen mask from and on the patient's face not only result in complicated procedures, but also increase the risk of infection in the process of surgical operation or health examination. Further, the patient might be subject to oxygen deficit and increased risk of losing life during the short time period of removing his medical oxygen mask.

SUMMARY OF THE INVENTION

A primary object of the present invention is to provide a face cushion having an inflatable body divided into a first and a second air bag, which are inflatable alternately with gas supplied from a gas supply device via different pipelines at different time points. By supplying the gas via selected pipelines to inflate the first or the second air bag, multiple portions of different heights and different combinations thereof can be produced on the inflatable body for the face cushion to more fitly contact with a patient's face, while allowing the patient's face to turn left and right.

Another object of the present invention is to provide a face cushion with an improved structural configuration, which allows a medical oxygen mask worn on a patient's face to pass through a hollow-out portion and a tubing of the medical oxygen mask to pass through a slit section, so that the patient need not to remove his medical oxygen mask and the tubing thereof before he lies on a medical treatment table in a prone position. That is, the patient may lie on the medical treatment table in the prone position while wearing his medical oxygen mask.

A further object of the present invention is to provide a face cushion having an inflatable body with an improved structural configuration, wherein two sheets forming the inflatable body are provided between them with a plurality of reinforcing patterns and a plurality of secondary reinforcing patterns to produce a plurality of relatively large contact areas between the two sheets, and the sheets are further provided at predetermined locations with through holes for precise alignment of the sheets with each other. The improved structural configuration of the inflatable body also includes an outer line segment located near edges of the inflatable body and an edge wrapping material covering the outer line segment, so that the face cushion includes multiple types of connecting means to provide enhanced connection between the two sheets and prevent the inflatable body from bursting by a large amount of gas instantaneously supplied thereinto.

To achieve the above and other objects, the face cushion according to the present invention includes a hollow-out portion, an inflatable body, a slit section and a plurality of inflating connections. The inflatable body includes a plurality of air bags that are inflated alternately with gas supplied from a gas supply device, so that different parts of a patient's face can contact with the face cushion intermittently.

According to a first preferred embodiment of the present invention, the hollow-out portion is located at a central area of the face cushion and has a T-shaped configuration. The slit section is communicably connected to a longitudinal part of the T-shaped configuration and extends in a direction parallel to a transverse part of the T-shaped configuration. The inflatable body is located around an outer side of the hollow-out portion and has an inner peripheral edge, which is located adjacent to and surrounds the hollow-out portion, an outer peripheral edge, and two slit edges located between the inner peripheral edge and the outer peripheral edge. An area of the inflatable body located between the inner peripheral edge and the outer peripheral edge is formed into a first air bag and a second air bag. A part of the first air bag extends around an outer side of the hollow-out portion, and a part of the second air bag extends around an outer side of the first air bag. The slit section is formed between the two slit edges. The inflating connections are separately connected to the first air bag and the second air bag, and the gas supply device is communicable with the inflating connections of the first air bag and the second air bag via different pipelines to inflate the first air bag and the second air bag alternately at different time points.

The inflatable body is formed by connecting two pieces of sheets together. The two sheets are further connected to each other along a continuous winding bond line to divide the inflatable body into the first air bag and the second air bag. The continuous winding bond line includes an outer line segment located near edges of the inflatable body, an inner line segment located near inner areas of the inflatable body, and a plurality of spacing line segments respectively configured into a reinforcing pattern. The two sheets are also connected to each other along at least one secondary bond line that is not intersected with the continuous winding bond line; and the at least one secondary bond line has a plurality of ends, which are respectively configured into a secondary reinforcing pattern.

The first air bag includes a first surrounding zone, a second surrounding zone and a third surrounding zone; and the second air bag includes a fourth surrounding zone and a fifth surrounding zone. The fourth surrounding zone is located between the first surrounding zone and the fifth surrounding zone, the fifth surrounding zone is located between the fourth surrounding zone and the second surrounding zone, and the second surrounding zone is located between the fifth surrounding zone and the third surrounding zone. One of the inflating connections is communicably connected to the third surrounding zone while the other one of the inflating connections is communicably connected to the fifth surrounding zone.

In a second preferred embodiment of the present invention, the face cushion further includes an edge wrapping material that is sewed onto the two sheets along the outer line segment of the continuous winding bond line, such that the edge wrapping material is fixed to the outer peripheral edge of the inflatable body.

In a third preferred embodiment of the present invention, the inflatable body is located around an outer side of the hollow-out portion and has an inner peripheral edge, which is located adjacent to and surrounds the hollow-out portion, an outer peripheral edge, and two slit edges located between the inner peripheral edge and the outer peripheral edge; and an area of the inflatable body located between the inner peripheral edge and the outer peripheral edge is formed into a first upper air bag, a first lower air bag located in alignment with the first upper air bag, a second upper air bag, and a second lower air bag located in alignment with the second upper air bag. A part of the first upper air bag and a part of the first lower air bag extend around a radially outer side of the hollow-out portion, a part of the second upper air bag extends around a radially outer side of the first upper air bag, and a part of the second lower air bag extends around a radially outer side of the first lower air bag.

In the third preferred embodiment, the inflating connections are separately connected to the first upper air bag, the first lower air bag, the second upper air bag and the second lower air bag, and the gas supply device is communicable with the inflating connections of the first upper air bag, the first lower air bag, the second upper air bag and the second lower air bag via different pipelines to inflate at least one of the first upper air bag, the first lower air bag, the second upper air bag and the second lower air bag at different time points.

In the third preferred embodiment, the inflatable body includes a first sheet, a second sheet, a third sheet and a fourth sheet connected to one another at the inner peripheral edge, the outer peripheral edge and the slit edges. The first sheet is connected to the second sheet, the third sheet is connected to the fourth sheet, and the second sheet is in contact with the third sheet. Moreover, the first sheet and the second sheet are further connected to each other along a continuous winding bond line to thereby isolate the first upper air bag from the second upper air bag, and the third sheet and the fourth sheet are further connected to each other along another continuous winding bond line to thereby isolate the first lower air bag from the second lower air bag. The continuous winding bond lines respectively include an outer line segment located near edges of the inflatable body, an inner line segment located near inner areas of the inflatable body, and a plurality of spacing line segments respectively configured into a reinforcing pattern.

In the third preferred embodiment, the first upper air bag and the first lower air bag together constitute a first part of the face cushion, and the second upper air bag and the second lower air bag together constitute a second part of the face cushion. The gas supply device can supply gas in a first gas supply mode. In the first gas supply mode, the gas supply device inflates the first part and the second part alternately for them to reach the same height.

According to a fourth preferred embodiment of the present invention, the gas supply device can further supply gas in a second gas supply mode. In the second gas supply mode, the gas supply device inflates the first part and the second part alternately for them to reach different heights.

According to a fifth preferred embodiment of the present invention, the first air bag includes a first beginning zone, that is located corresponding to one of the inflating connections, a first surrounding zone, a plurality of first supporting zones, at least one second surrounding zone and at least one third surrounding zone; and the second air bag includes a second beginning zone, that is located corresponding to another one of the inflating connections a plurality of second supporting zones, at least one fourth surrounding zone, at least one fifth surrounding zone and at least one sixth surrounding zone. The first supporting zones and the second supporting zones are arranged alternately on the inflatable body at a position corresponding to a patient's forehead.

The first supporting zones and the second supporting zones are located in alignment with a raised portion on a supporting pad of a medical treatment table, on which the face cushion is supported for use.

In the fifth preferred embodiment, two fourth surrounding zones are extended from the second beginning zone, and the first surrounding zone, the first supporting zones and the second supporting zones are located between the two fourth surrounding zones; two second surrounding zones are extended from the first surrounding zone, and the fifth surrounding zones are located between the two second surrounding zones; two fifth surrounding zones are extended from the second beginning zone; the third surrounding zones are extended from the first beginning zone and the second surrounding zones; and two sixth surrounding zones are further extended from the second beginning zone.

In the present invention, the continuous winding bond line further has a plurality of through holes formed thereon. The sheets of the inflatable body can be precisely positioned for connected to each other by aligning corresponding through holes with one another.

The face cushion in the fifth preferred embodiment is supported on a supporting pad, which includes a recessed portion, a raised portion, a secondary hollow-out portion, a cut portion, and a tubing guide portion. The recessed portion is located adjacent to the raised portion, the secondary hollow-out portion and the cut portion are formed in the recessed portion and communicably connected to each other, and the tubing guide portion and the secondary hollow-out portion are located at two opposite ends of the cut portion. The face cushion in use is placed on top of the recessed portion and the raised portion with the hollow-out portion aligned with the secondary hollow-out portion.

The above-mentioned supporting pad is formed of a left pad and a right pad that are arranged side by side. The cut portion is formed between the left and the right pad; and the recessed portion, the raised portion and the secondary hollow-out portion respectively have one half of them formed on the left pad and the other half of them symmetrically formed on the right pad.

The present invention is featured in that the face cushion includes a hollow-out portion, an inflatable body, a slit section and a plurality of inflating connections. The hollow-out portion and the slit section are located adjacent to the inflatable body. A patient wearing a medical oxygen mask with tubing may lie on a medical treatment table in a prone position and set his face on the inflatable body of the face cushion with the medical oxygen mask passing through the hollow-out portion and the tubing passing through the slit section. Therefore, the patient needs not to remove his medical oxygen mask and the tubing thereof before he lies on the medical treatment table in the prone position and set his face on the face cushion. The inflatable body is divided into a first air bag and a second air bag, which are inflated alternately with gas supplied from a gas supply device at different time points. More specifically, the gas can be supplied in one of a first and a second gas supply mode to inflate the first or the second air bag selectively via different pipelines, so that different height combinations of the first and the second air bag can be produced on the inflatable body, allowing different parts of the patient's face to contact with the face cushion intermittently. The sheets forming the inflatable body of the face cushion are further connected to one another through a continuous winding bond line and at least one secondary bond line to enhance the connection of the two sheets with each other. Since the sheets of the face cushion are connected to one another by multiple ways, the inflatable body is protected from bursting by a large amount of gas instantaneously supplied thereinto.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
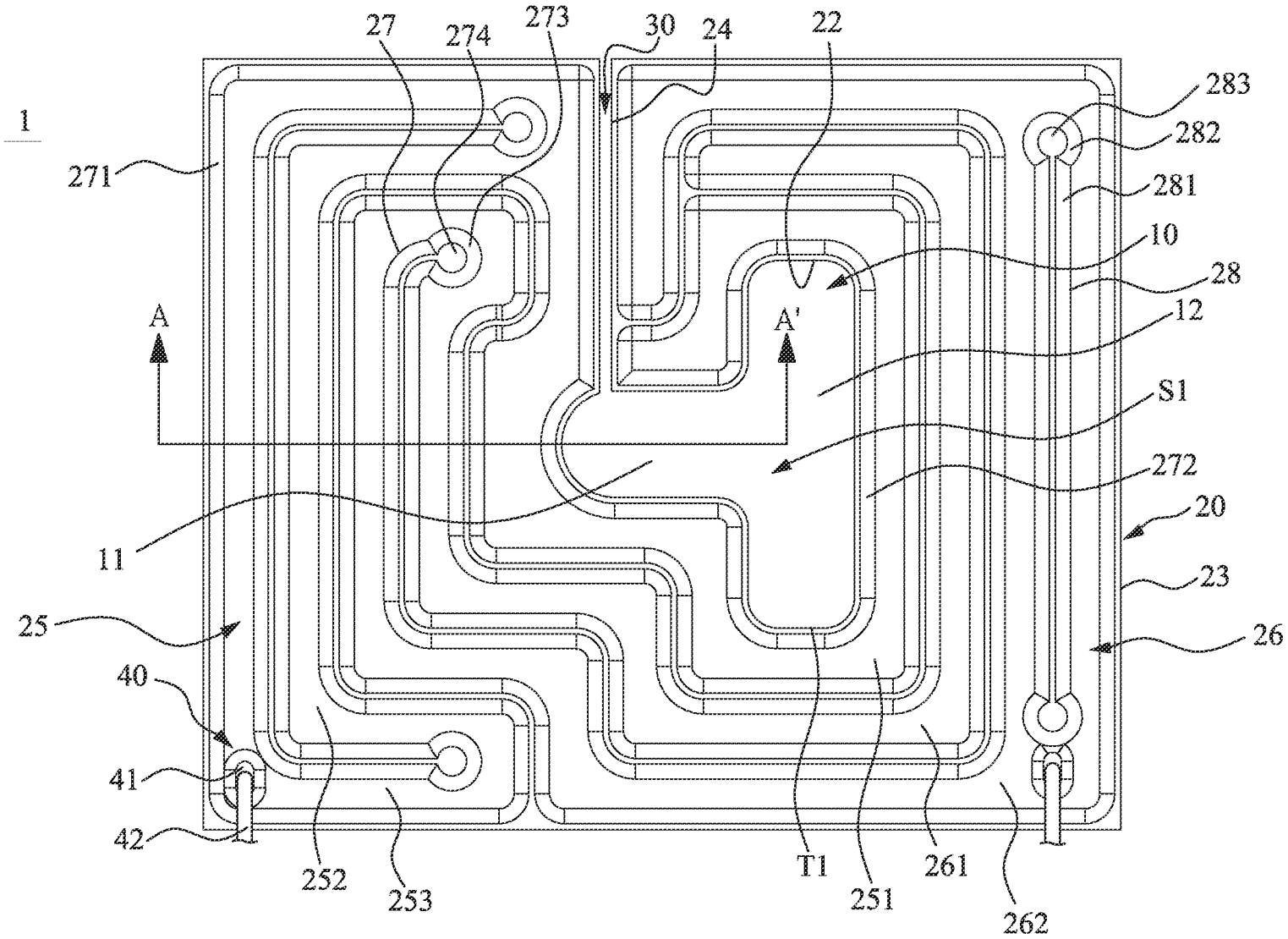
FIG. 1 is a schematic top view of a face cushion according to a first preferred embodiment of the present invention.

The present invention will now be described with some preferred embodiments thereof and by referring to the accompanying drawings. For the purpose of easy to understand, elements that are the same in the preferred embodiments are denoted by the same reference numerals.

Please refer to FIG. 1. A face cushion 1 according to a first preferred embodiment of the present invention mainly includes a hollow-out portion 10, an inflatable body 20, a slit section 30, and a plurality of inflating connections 40. The hollow-out portion 10 is located at a central portion 51 of the face cushion 1 and includes a longitudinal part 11 communicably connected to the slit section 30 and a transverse part 12 extended in a direction parallel to the slit section 30. The longitudinal part 11 is so connected to the transverse part 12 that the hollow-out portion 10 has a T-shaped configuration T1.

Figure 4:
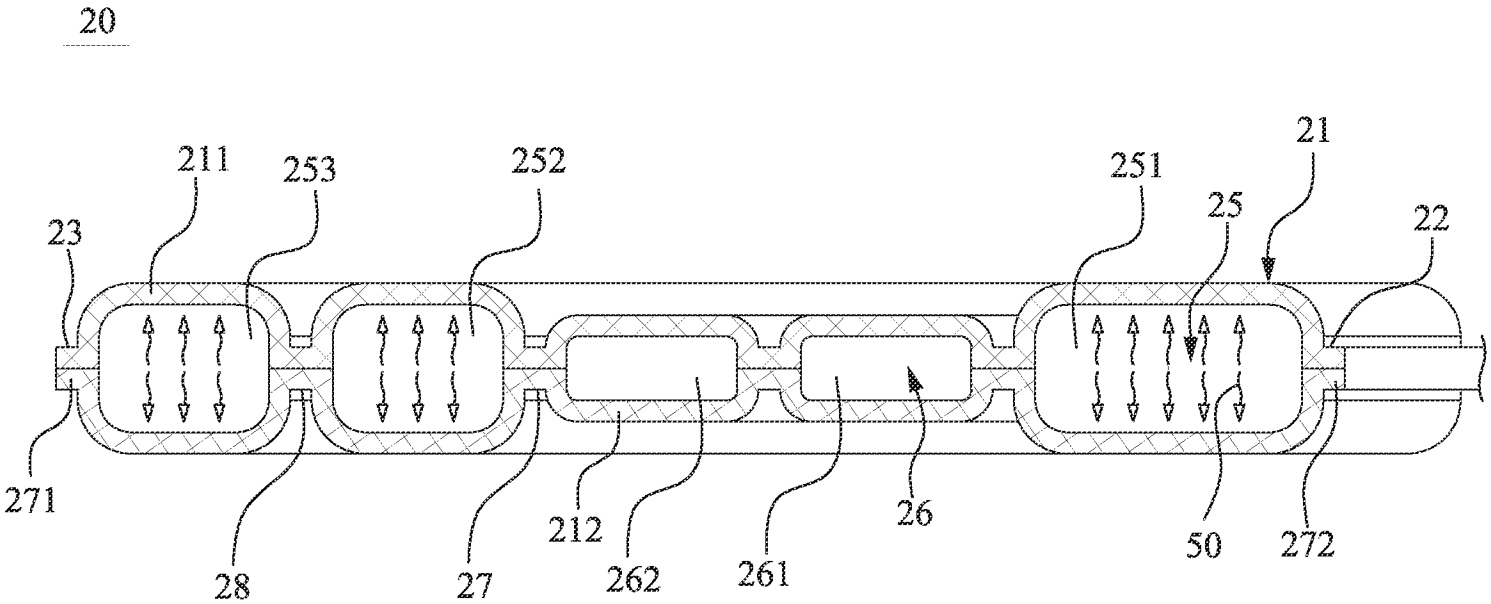
FIG. 4 is a sectional view taken along line AA' of FIG. 1.

As can be seen in FIG. 4, the inflatable body 20 is formed by connecting two pieces of sheets 21 together, namely, a first sheet 211 and a second sheet 212. Please refer to FIGS. 1 and 4. The inflatable body 20 is located around an outer side of the hollow-out portion 10 and is defined by an inner peripheral edge 22, which is located adjacent to and surrounds the hollow-out portion 10, an outer peripheral edge 23 located around the face cushion 1, and two slit edges 24 located between the inner peripheral edge 22 and the outer peripheral edge 23. The two sheets 211, 212 are connected to each other along the inner peripheral edge 22, the outer peripheral edge 23 and the slit edges 24. An area of the inflatable body 20 located between the inner peripheral edge 22 and the outer peripheral edge 23 is formed into a first air bag 25 and a second air bag 26. A part of the first air bag 25 extends around an outer side of the hollow-out portion 10, while a part of the second air bag 26 extends around an outer side of the first air bag 25.

Please refer to FIG. 4. The two sheets 21 are further connected to each other along a continuous winding bond line 27 and at least one secondary bond line 28 located at an outer side of the continuous winding bond line 27. The continuous winding bond line 27 divides the inflatable body 20 into the first air bag 25 and the second air bag 26. In the illustrated first preferred embodiment, two secondary bond lines 28 are separately provided on a portion of the first air bag 25 that is located at a left side of the face cushion 1 and on a portion of the second air bag 26 that is located at a right side of the face cushion 1. It is noted the continuous winding bond line 27 and the secondary bond line 28 are independent of one another, such that the secondary bond line 28 does not communicate with the continuous winding bond line 27. The continuous winding bond line 27 includes an outer line segment 271, an inner line segment 272, and a plurality of spacing line segments 273. The outer line segment 271 is located near edges of the inflatable body 20, the inner line segment 272 is located near inner areas of the inflatable body 20, and the spacing line segments 273 are respectively configured into a reinforcing pattern 274.

Every secondary bond line 28 includes an intermediate line segment 281 and a plurality of ends 282. The intermediate line segment 281 is located between the outer line segment 271 and the inner line segment 272, and each of the ends 282 is configured into a secondary reinforcing pattern 283. The reinforcing pattern 274 has a width larger than that of the continuous winding bond line 27, and the secondary reinforcing pattern 283 has a width larger than that of the secondary bond line 28. In other words, the reinforcing pattern 274 has an area larger than a cross-sectional area of the continuous winding bond line 27, and the secondary reinforcing pattern 283 has an area larger than a cross-sectional area of the secondary bond line 28. With these arrangements, the two sheets 21 can be more firmly connected to one another to prevent the inflatable body 20 from bursting when an excessive amount of gas 50 is quickly supplied into the first air bag 25 and the second air bag 26. It is noted the reinforcing patterns 274 and the secondary reinforcing patterns 283 can respectively form a single circular shape, a triangular shape, a plurality of connected circular shapes, or any other shape.

Figure 2:
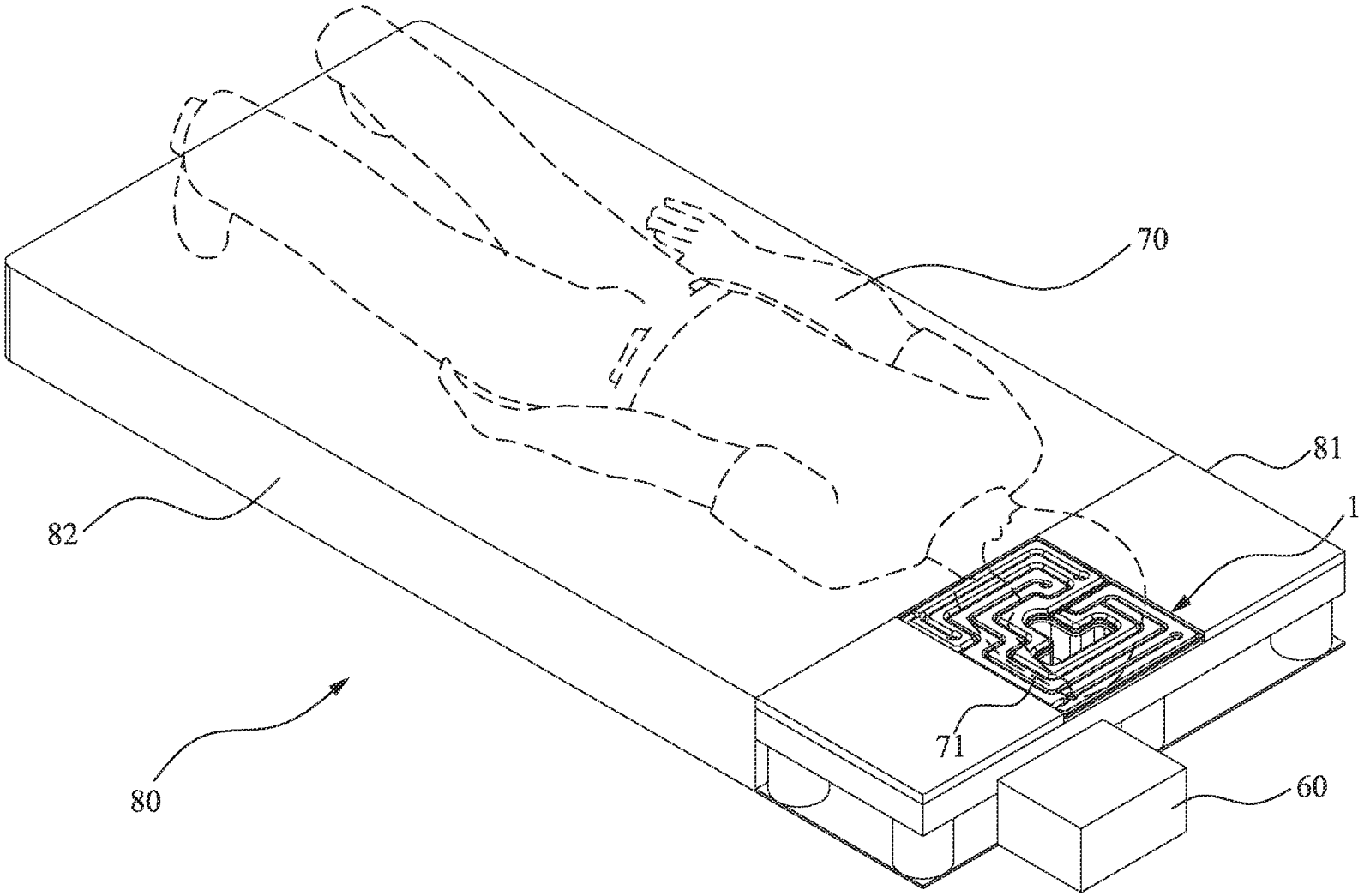
FIG. 2 shows the position of the face cushion according to the first preferred embodiment of the present invention on a medical treatment table.
Figure 3:
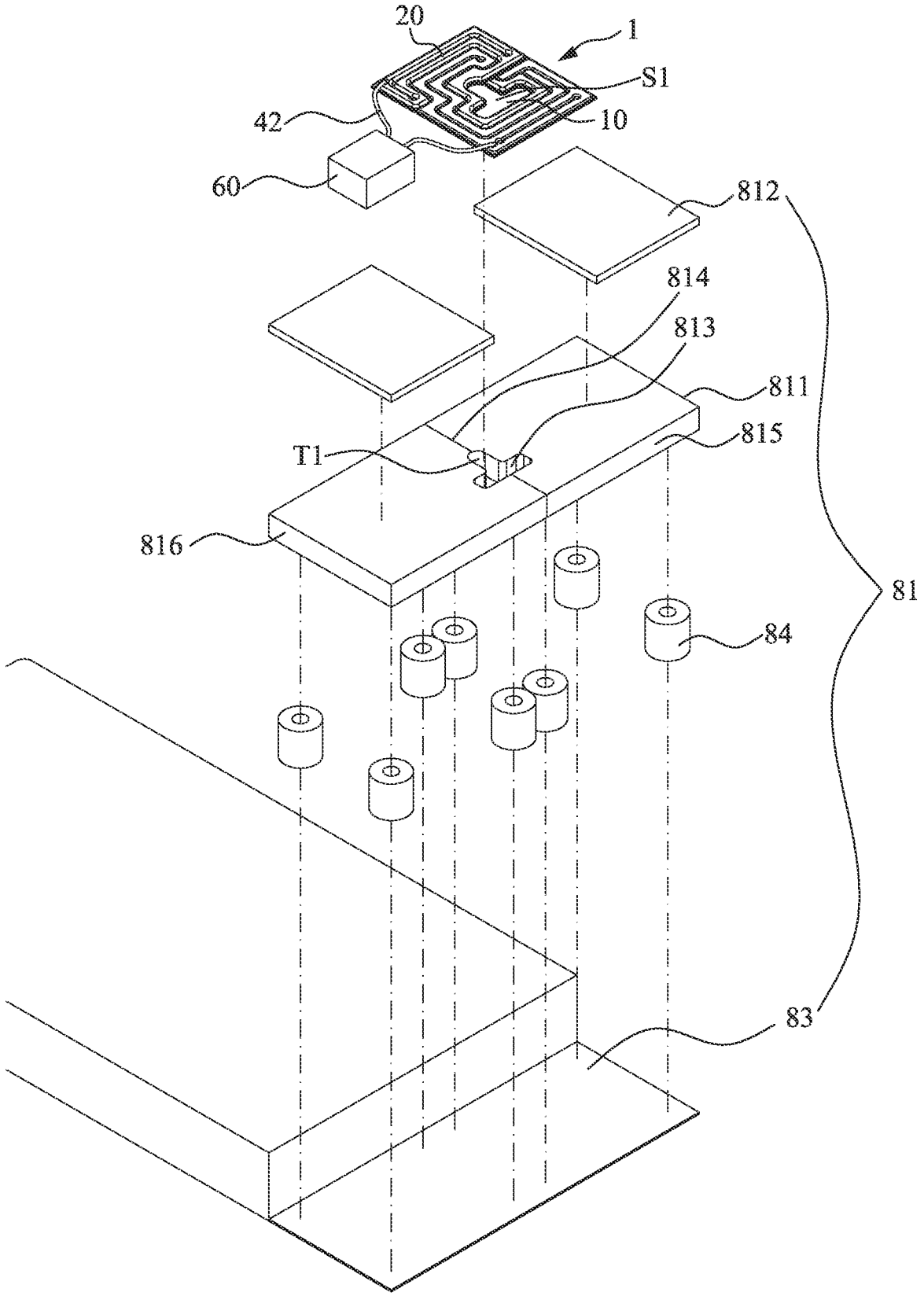
FIG. 3 is an exploded perspective view showing the positional relation between the face cushion according to the first preferred embodiment of the present invention and a supporting pad of the medical treatment table.

Please refer to FIGS. 1, 2 and 3. The slit section 30 is formed between the two slit edges 24 and is so located that it is communicable with the longitudinal part 11 of the hollow-out portion 10 while extends in a direction parallel to the transverse part 12 of the hollow-out portion 10. More specifically, the slit section 30 is located between the inner peripheral edge 22 and the outer peripheral edge 23 of the inflatable body 20. The two slit edges 24 of the inflatable body 20 can be selectively moved away from or toward the slit section 30 by moving areas of the inflatable body located adjacent to two opposite sides of the slit section 30, so as to provide a proper limiting or fixing space and location on the inflatable body 20. The inflating connections 40 respectively include an opening 41 formed at a corner of the face cushion 1 and a pipeline 42 set in the opening 41. The pipeline 42 connects to and extends between the opening 41 and a gas supply device 60. The inflating connections 40 are separately connected to the first and the second air bag 25, 26, such that the first air bag 25 and the second air bag 26 can be inflated alternately by the gas supply device 60 via different pipelines 42 at different time points. With this arrangement, it allows different areas on the face of a patient 70 to contact with the face cushion 1 intermittently.

As shown in FIGS. 1 to 4, the face cushion 1 is mounted to a front end of a medical treatment table 80, which includes a supporting pad 81 and a table main body 82. The supporting pad 81 includes a bottom pad 811 and two limiting pads 812 disposed above the bottom pad 811. The bottom pad 811 is provided with a secondary hollow-out portion 813 and a cut portion 814, and the secondary hollow-out portion 813 is communicably connected to the cut portion 814. The bottom pad 811 is formed of a left pad 815 and a right pad 816 that are arranged side by side, such that the cut portion 814 is formed between the left pad 815 and the right pad 816. One half of the secondary hollow-out portion 813 is formed on the left pad 815, and another half of the secondary hollow-out portion 813 is symmetrically formed on the right pad 816 with respect to the left pad 815. The secondary hollow-out portion 813 is located at a central area of the bottom pad 811 and also presents a T-shaped configuration T1. The face cushion 1 is placed on a top of the bottom pad 811 between the two limiting pads 812, such that the first sheet 211 of the inflatable body 20 faces upward for contacting with the patient's face, the second sheet 212 of the inflatable body 20 faces downward to contact with the bottom pad 811, and the hollow-out portion 10 of the face cushion 1 is aligned with the secondary hollow-out portion 813 on the bottom pad 811.

The supporting pad 81 further includes a bottom board 83 and a plurality of spacers 84 disposed between the bottom pad 811 and the bottom board 83. The table main body 82 of the medical treatment table 80 supports a portion of the patient's 70 body that is lower than the patient's head. With the face cushion 1 and the supporting pad 81 according to the present invention, the patient 70 wearing a medical oxygen mask with tubing (not shown) can directly lie on the medical treatment table 80 in a prone position without the need of removing the medical oxygen mask and the tubing thereof. When the patient 70 has his face in direct contact with the face cushion 1, the hollow-out portion 10 and the secondary hollow-out portion 813 serve to receive the medical oxygen mask while the slit section 30 serves to receive the tubing of the medical oxygen mask therein. Thus, the patient 70 can directly lie on the medical treatment table 80 in the prone position while wearing the medical oxygen mask.

Please refer to FIGS. 1, 2 and 4. In the first preferred embodiment, the first air bag 25 includes a first surrounding zone 251, a second surrounding zone 252 and a third surrounding zone 253; and the second air bag 26 includes a fourth surrounding zone 261 and a fifth surrounding zone 262. The fourth surrounding zone 261 is located between the first surrounding zone 251 and the fifth surrounding zone 262; the fifth surrounding zone 262 is located between the fourth surrounding zone 261 and the second surrounding zone 252; and the second surrounding zone 252 is located between the fifth surrounding zone 262 and the third surrounding zone 253. One of the two pipelines 42 is connected to the opening 41 that is located in the third surrounding zone 253, and the other pipeline 42 is connected to the opening 41 that is located in the fifth surrounding zone 262. With these arrangements, an operator may selectively inflate only the first air bag 25, or only the second air bag 26, or both of the first and the second air bag 25, 26.

Please refer to FIGS. 1 and 4. The gas 50 supplied from the gas supply device 60 can be transported into the first air bag 25 via the pipeline 42 located corresponding to the third surrounding zone 253. In this case, the gas 50 is filled and stays in the first, the second and the third surrounding zone 251, 252, 253. Since the gas 50 is not transported into the second air bag 26, the inflatable body 20 now includes the first air bag 25 inflated with the gas 50 and the second air bag 26 not inflated with the gas 50. That is, through manipulation of the gas supply device 60, zones with different heights can be produced on the face cushion 1 to match the patient's facial profile, giving the face cushion 1 increased convenience and flexibility in use.

Figure 5:
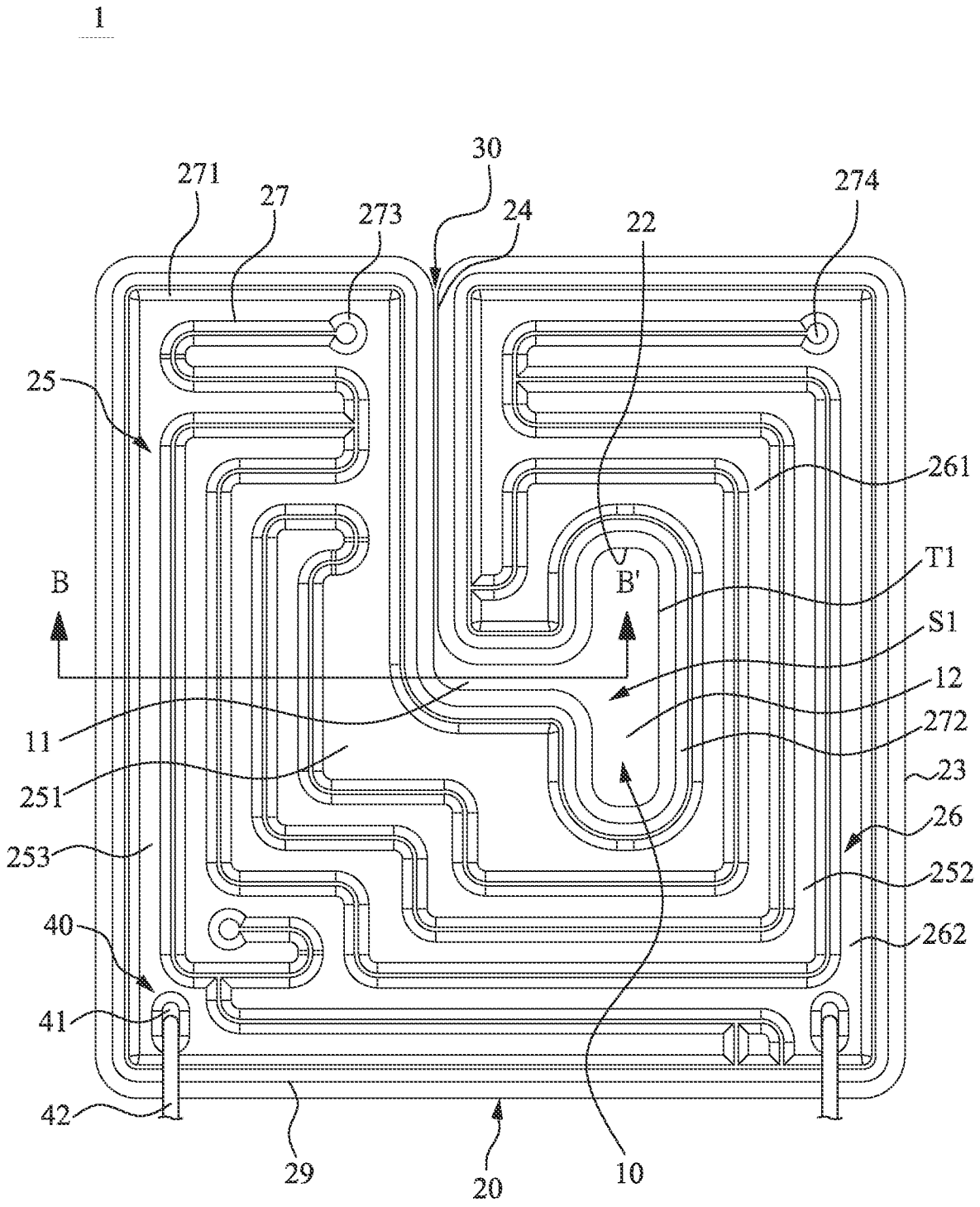
FIG. 5 is a schematic top view of a face cushion according to a second preferred embodiment of the present invention.
Figure 6:
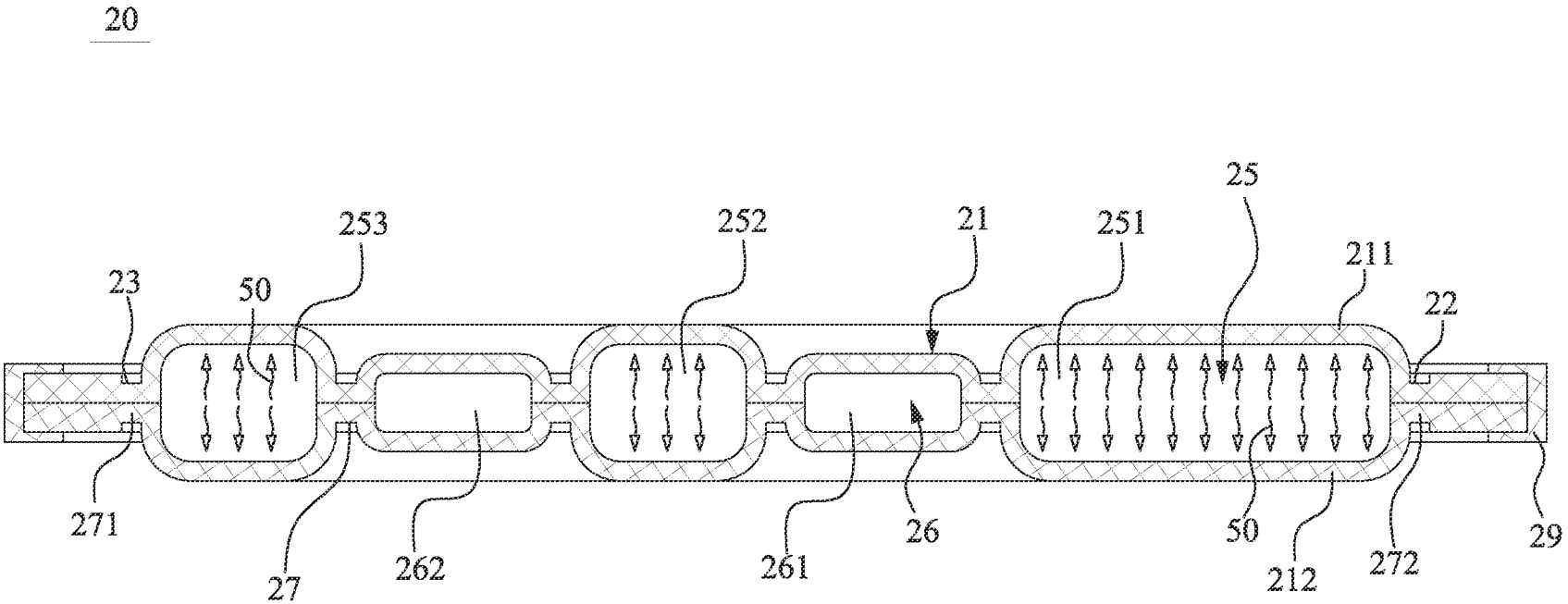
FIG. 6 is a sectional view taken along line BB' of FIG. 5.

Please refer to FIGS. 5 and 6, in which a face cushion 1 according to a second preferred embodiment of the present invention is shown. In the second preferred embodiment, the inflatable body 20 has a configuration different from that in the first preferred embodiment. More specifically, the inflatable body 20 of the face cushion 1 in the second preferred embodiment further includes an edge wrapping material 29 but omits the secondary bond lines 28. As shown, the edge wrapping material 29 is sewed onto the sheets 21 along the outer line segment 271 to cover all edges of the inflatable body 20, such that the edge wrapping material 29 is fixed to the outer line segment 271. With this arrangement, the continuous winding bond line 27 further enhances the connection of the two sheets 21 of the inflatable body 20 to each other and the patient 70 is protected against scratching by any sharp portion on the continuous winding bond line 27 around the face cushion 1.

In the second preferred embodiment, the first air bag 25 of the inflatable body 20 includes a first surrounding zone 251, a second surrounding zone 252, and a third surrounding zone 253; and the second air bag 26 includes a fourth surrounding zone 261 and a fifth surrounding zone 262. The fourth surrounding zone 261 is located between the first surrounding zone 251 and the second surrounding zone 252; the second surrounding zone 252 is located between the fourth surrounding zone 261 and the fifth surrounding zone 262; and the fifth surrounding zone 262 is located between the second surrounding zone 252 and the third surrounding zone 253. One of the two pipelines 42 is connected to the opening 41 that is located in the third surrounding zone 253, and the other pipeline 42 is connected to the opening 41 that is located in the fifth surrounding zone 262. When the gas 50 is supplied into the first air bag 25 via the pipeline 42 located corresponding to the third surrounding zone 253, the gas 50 is filled and stays in the first, the second and the third surrounding zone 251, 252, 253. Therefore, the inflated and expanded first air bag 25 and the non-inflated and relatively flat second air bag 26 are arranged alternately on the inflatable body 20 of the face cushion 1.

Figure 7:
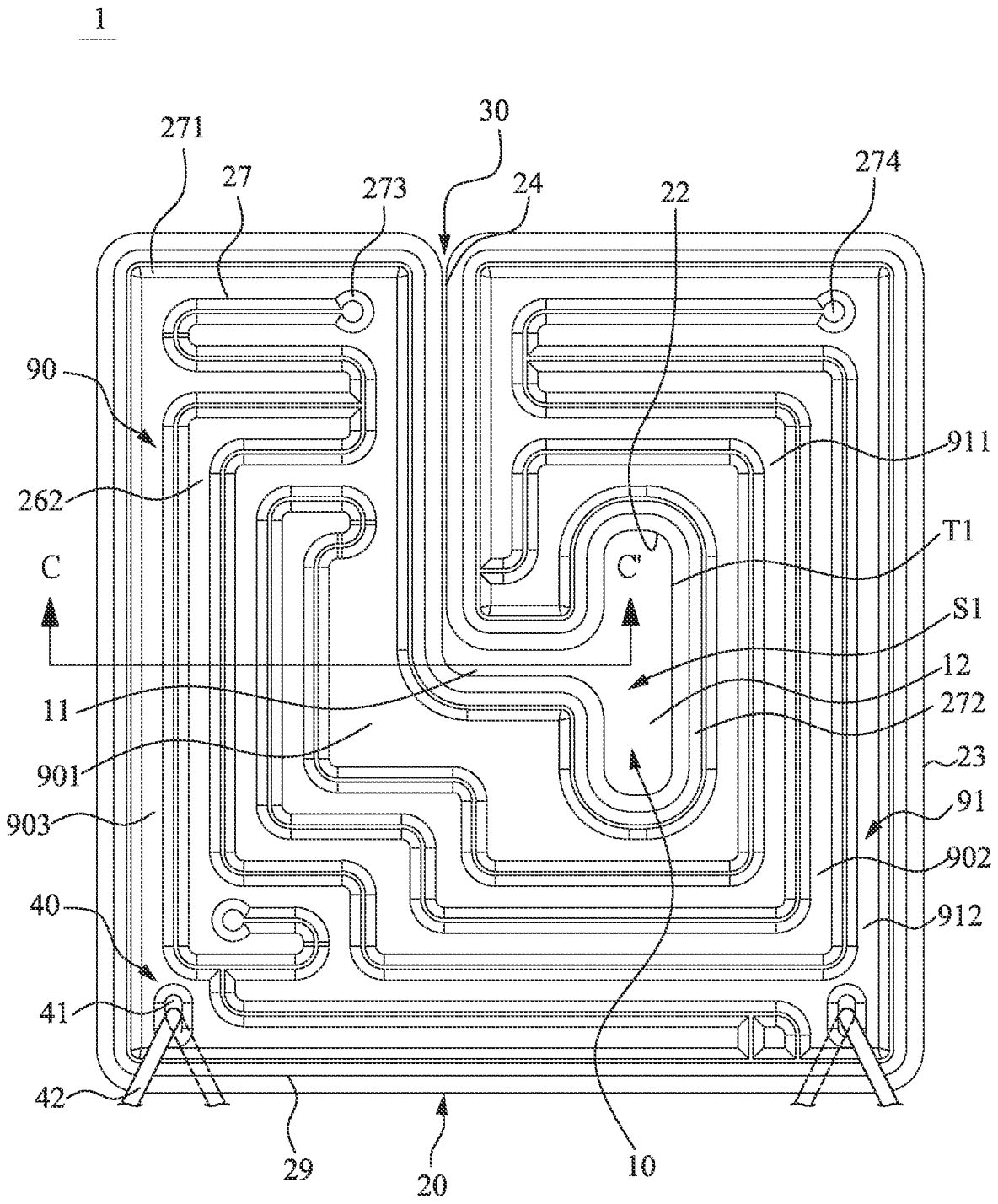
FIG. 7 is a schematic top view of a face cushion according to a third preferred embodiment of the present invention.
Figure 8:
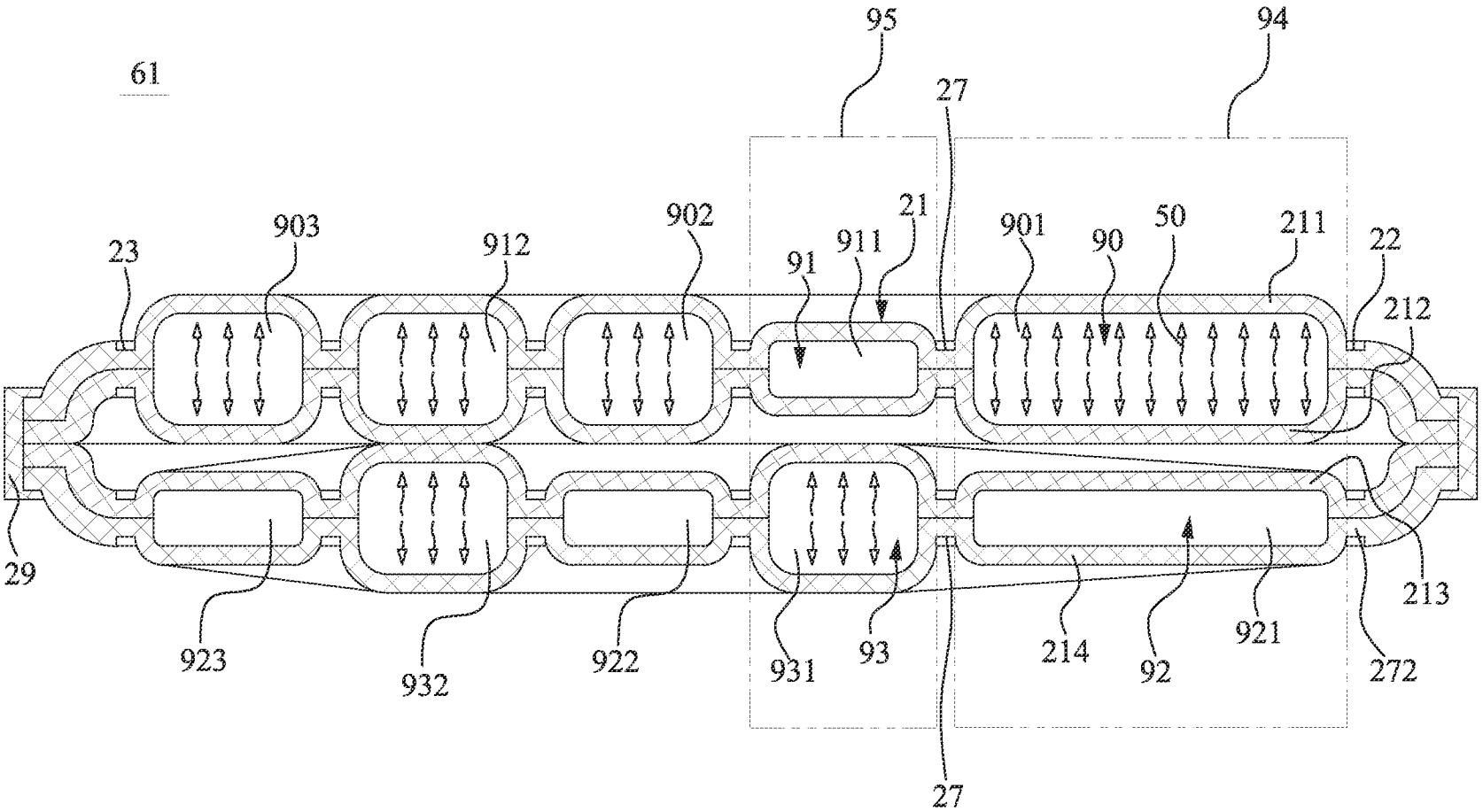
FIG. 8 is a sectional view taken along line CC' of FIG. 7 with an inflatable body of the face cushion according to the third preferred embodiment of the present invention being inflated in a first gas supply mode.

Please refer to FIGS. 7 and 8, in which a face cushion 1 according to a third preferred embodiment of the present invention is shown. The third preferred embodiment is different from the second preferred embodiment in the configuration of the inflatable body 20 and the structure of the inflating connections 40. As shown, the inflatable body 20 in the third preferred embodiment includes a first sheet 211, a second sheet 212, a third sheet 213 and a fourth sheet 214 connected to one another at the inner peripheral edge 22, the outer peripheral edge 23 and the slit edges 24. Further, the first sheet 211 and the second sheet 212 are connected to each other to form a first upper air bag 90 and a second upper air bag 91; and the third sheet 213 and the fourth sheet 214 are connected to each other to form a first lower air bag 92 and a second lower air bag 93. Some parts of the second sheet 212 is in contact with some parts of the third sheet 213, such that the first upper air bag 90 and the first lower air bag 92 are aligned with each other to together constitute a first part 94 of the face cushion 1, and the second upper air bag 91 and the second lower air bag 93 are aligned with each other to together constitute a second part 95 of the face cushion 1. A part of the first upper air bag 90 and a part of the first lower air bag 92 are located around a radially outer side of the hollow-out portion 10; meanwhile, a part of the second upper air bag 91 is located around a radially outer side of the first upper air bag 90 and a part of the second lower air bag 93 is located around a radially outer side of the first lower air bag 92.

The first sheet 211 and the second sheet 212 are further connected to each other along a continuous winding bond line 27 to thereby isolate the first upper air bag 90 from the second upper air bag 91. Similarly, the third sheet 213 and the fourth sheet 214 are further connected to each other along another continuous winding bond line 27 to isolate the first lower air bag 92 from the second lower air bag 93. In the third preferred embodiment, the first upper air bag 90 includes a first surrounding zone 901, a second surrounding zone 902 and a third surrounding zone 903; the second upper air bag 91 includes a fourth surrounding zone 911 and a fifth surround zone 912; the first lower air bag 92 includes a first secondary surrounding zone 921, a second secondary surrounding zone 922 and a third secondary surrounding zone 923; and the second lower air bag 93 includes a fourth secondary surrounding zone 931 and a fifth secondary surrounding zone 932. The fourth surrounding zone 911 of the inflatable body 20 is located between the first surrounding zone 901 and the second surrounding zone 902; the second surrounding zone 902 is located between the fourth surrounding zone 911 and the fifth surrounding zone 912; and the fifth surrounding zone 912 is located between the second surrounding zone 902 and the third surrounding zone 903. Similarly, the fourth secondary surrounding zone 931 of the inflatable body 20 is located between the first secondary surrounding zone 921 and the second secondary surrounding zone 922; the second secondary surrounding zone 922 is located between the fourth secondary surrounding 931 and the fifth secondary surrounding zone 932; and the fifth secondary surrounding zone 932 is located between the second secondary surrounding zone 922 and the third secondary surrounding zone 923.

The inflating connections 40 are separately connected to the first upper air bag 90, the second upper air bag 91, the first lower air bag 92 and the second lower air bag 93, such that the gas supply device 60 (referring to FIG. 3) is communicable with the first upper air bag 90, the second upper air bag 91, the first lower air bag 92 and the second lower air bag 93 via different pipelines 42, and at least one of the first upper air bag 90, the second upper air bag 91, the first lower air bag 92 and the second lower air bag 93 is inflated with the gas 50 transported from the gas supply device 60 at different times. In a first gas supply mode 61, of the gas supply device 60, the gas 50 is transported into the first upper air bag 90, the second upper air bag 91 and the second lower air bag 93 via corresponding pipelines 42, the gas 50 is filled and stays in the first surrounding zone 901, the second surrounding zone 902, the third surrounding zone 903, the fourth secondary surrounding zone 931, the fifth surrounding zone 912 and the fifth secondary surrounding zone 932. Therefore, the inflated and expanded first upper air bag 90, second upper air bag 91 and second lower air bag 93 and the non-inflated and relatively flat first lower air bag 92 are arranged alternately on the inflatable body 20 of the face cushion 1. When the gas supply device 60 supplies the gas 50 in the first gas supply mode 61 to inflate the first part 94 and the second part 95 of the face cushion 1 alternately, the first part 94 can reach a height the same as that of the second part 95.

Figure 9:
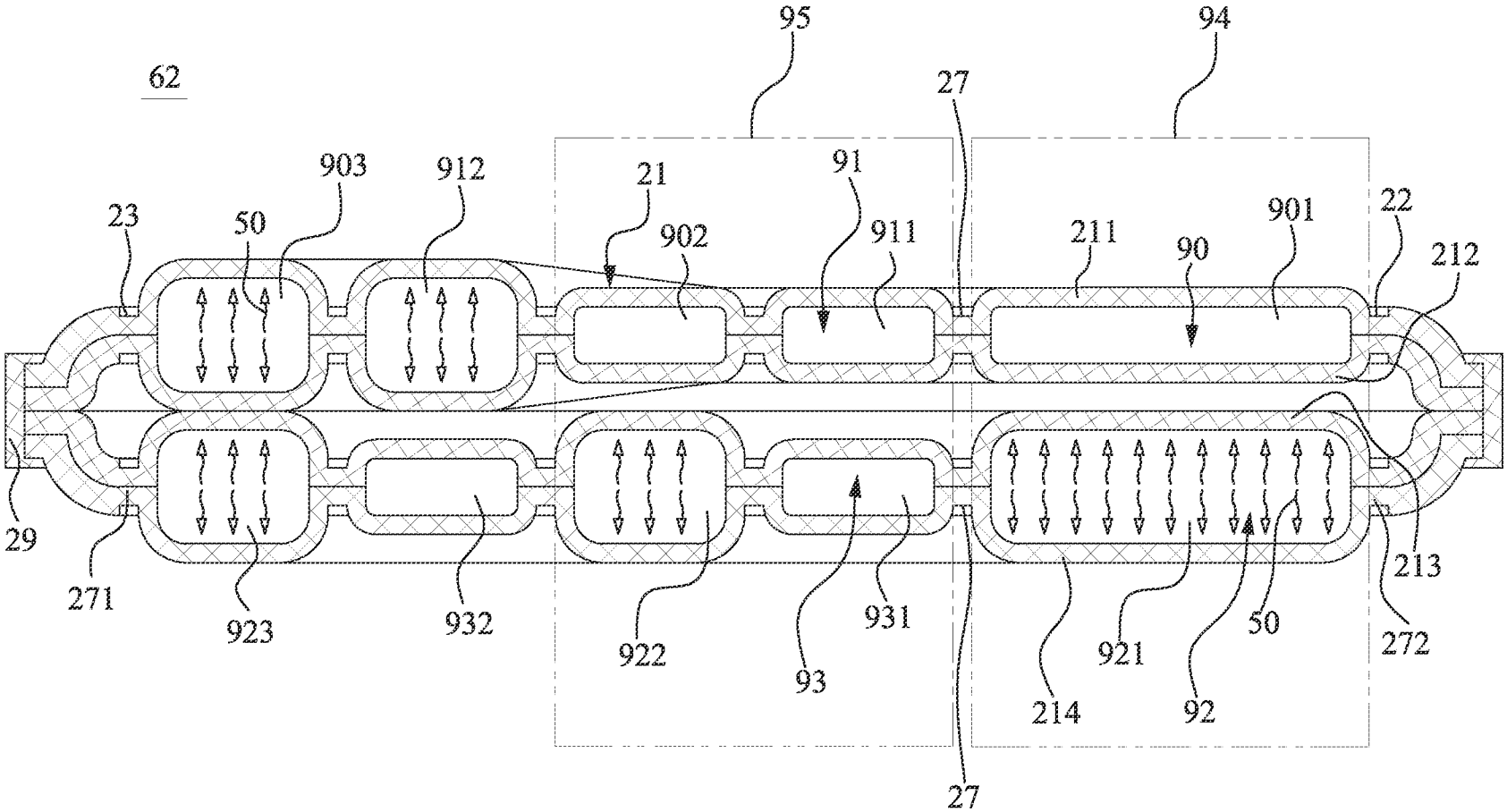
FIG. 9 is a sectional view taken along line CC' of FIG. 7 showing an inflatable body of the face cushion according to a fourth preferred embodiment of the present invention being inflated in a second gas supply mode.

Please refer to FIGS. 7 and 9. A face cushion 1 according to a fourth preferred embodiment of the present invention is different from the third one in that the inflatable body 20 of the face cushion 1 in the fourth preferred embodiment can further be inflated in a second gas supply mode 62. When the inflatable body 20 is inflated in the second gas supply mode, the gas 50 from the gas supply device 60 passes through the pipelines 42 into the first upper air bag 90, the second upper air bag 91 and the first lower air bag 92, such that the gas 50 is filled and stays in the first secondary surrounding zone 921, the second secondary surrounding zone 922, the third surrounding zone 903, the third secondary surrounding zone 923 and the fifth surrounding zone 912. The inflated and expanded first upper air bag 90, second upper air bag 91 and first lower air bag 92 and the non-inflated and relatively flat second lower air bag 93 are arranged alternately on the inflatable body 20 of the face cushion 1. When the gas supply device 6 supplied the gas 50 in the second gas supply mode 62 to inflate the first part 94 and the second part 95 of the face cushion 1 alternately, the first part can reach a height higher than that of the second part 95.

Figure 10:
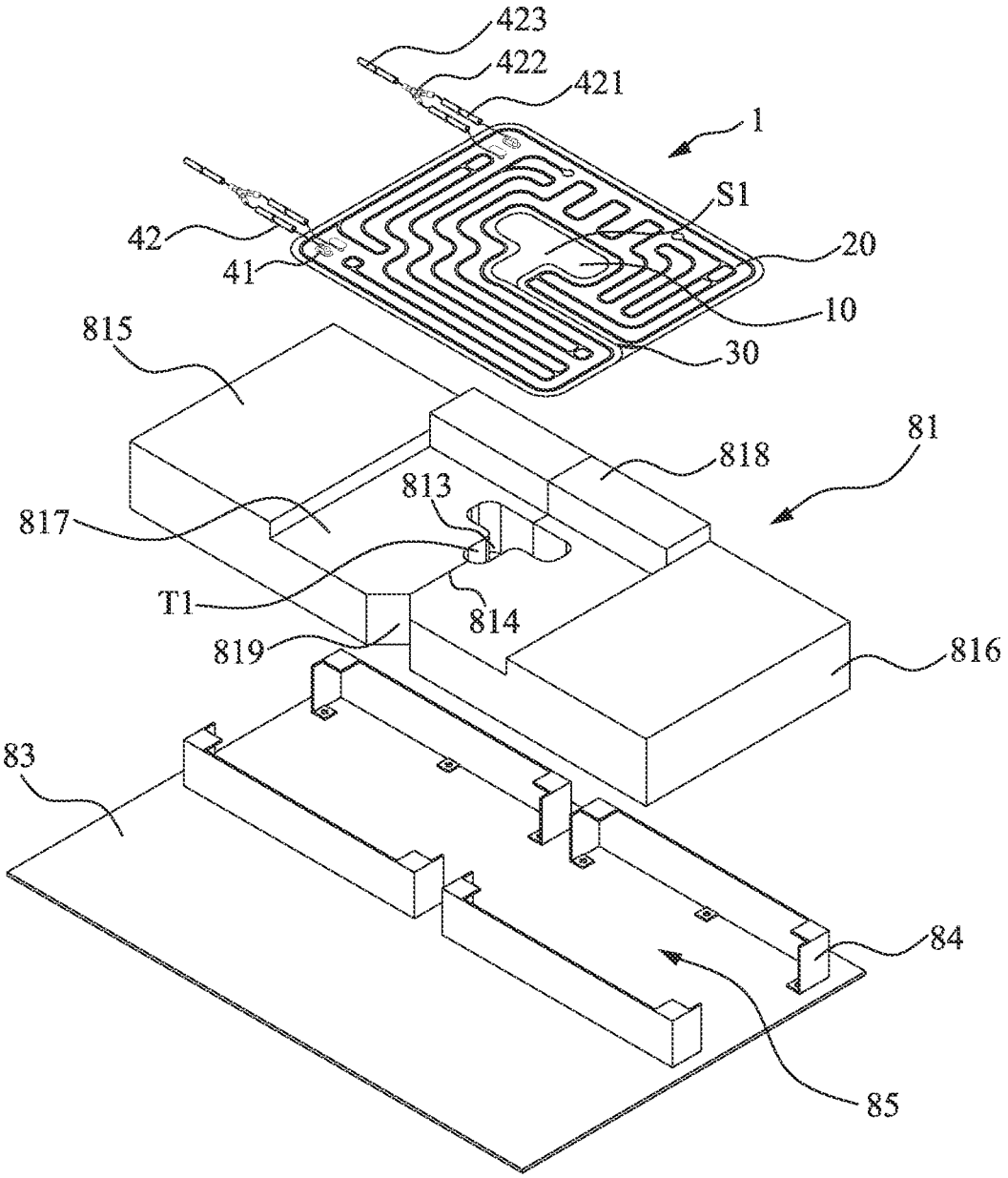
FIG. 10 is an exploded perspective view showing the positional relation between the face cushion according to a fifth preferred embodiment of the present invention and the supporting pad of the medical treatment table.
Figure 11:
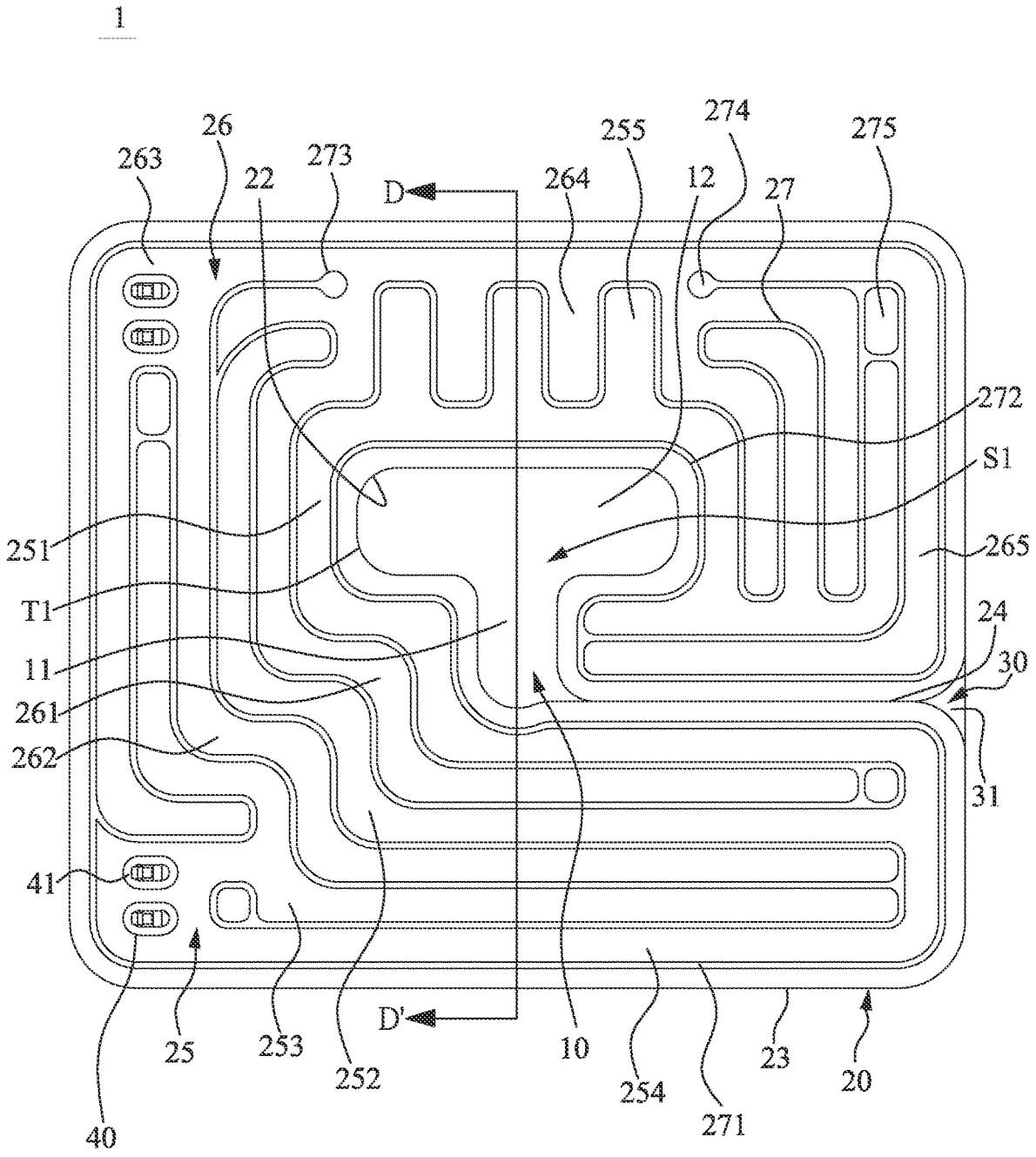
FIG. 11 is a schematic top view of the face cushion according to the fifth preferred embodiment of the present invention.
Figure 12:
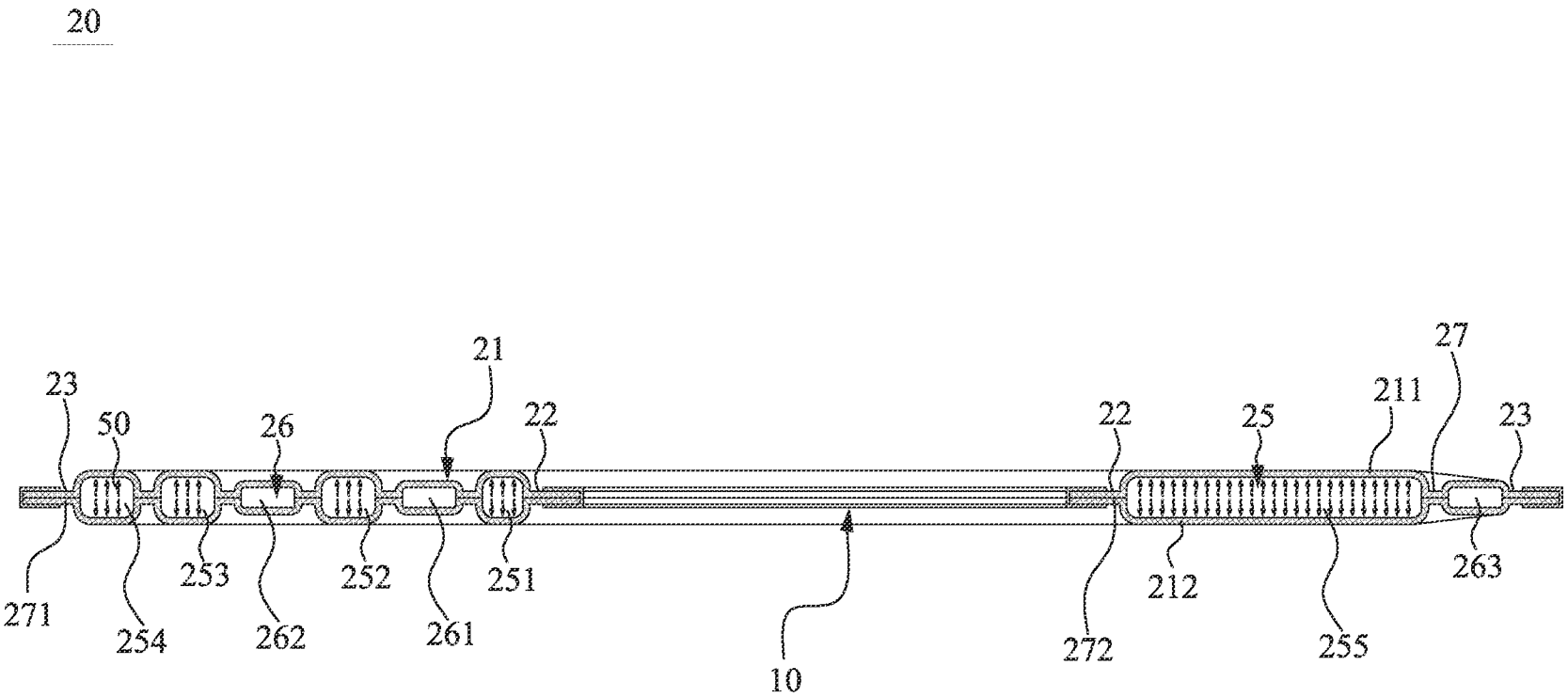
FIG. 12 is a sectional view taken along line DD' of FIG. 11.

Please refer to FIGS. 10, 11 and 12, in which a face cushion 1 according to a fifth preferred embodiment of the present invention is shown. The fifth preferred embodiment is different from the first preferred embodiment in the configuration of the inflatable body 20 and of the supporting pad 81 as well as the structure of the inflating connections 40. As shown, the inflatable body 20 of the face cushion 1 of the fifth preferred embodiment has a first air bag 25 that includes a first beginning zone 254, a first surrounding zone 251, a plurality of first supporting zones 255, at least one second surrounding zone 252 and at least one third surrounding zone 253, and a second air bag 26 that includes a second beginning zone 263, that is located corresponding to another one of the inflating connections a plurality of second supporting zones 264, at least one fourth surrounding zone 261, at least one fifth surrounding zone 262 and at least one sixth surrounding zone 265. The first beginning zone 254 and the second beginning zone 263 are located parallel to each other; and the first supporting zones 255 and the second supporting zones 264 are located parallel to one another. The inflating connections 40 are spaced on the same side of the face cushion 1; and the slit section 30 has an outlet 31 located at another side of the face cushion 1 opposite to the side with the inflating connections 40.

In the illustrated FIG. 11, two fourth surrounding zones 261 are extended from the second beginning zone 263, such that the first surrounding zone 251, the first supporting zones 255 and the second supporting zones 264 are located between the two fourth surrounding zones 261; two second surrounding zones 252 are extended from the first surrounding zone 251, and two fifth surrounding zone 262 are located between the two second surrounding zones 252; two fifth surrounding zones 262 are extended from the second beginning zone 263; the third surrounding zones 253 are extended from the first beginning zone 254 and the second surrounding zones 252; and two sixth surrounding zones 265 are further extended from the second beginning zone 263.

The continuous winding bond line 27 of the inflatable body 20 in the fifth preferred embodiment further encloses a plurality of through holes 275 on the inflatable body 20. The through holes 275 are separately located between the first beginning zone 254 and the third surrounding zone 253, between the first surrounding zone 251 and the second surrounding zone 252, and between the fifth surrounding zone 262 and the sixth surrounding zone 265 for fixing four corners of the face cushion 1 in place. The two sheets 21 can be precisely positioned for connecting to each other by aligning corresponding through holes 275 with one another. According to the present invention, the through holes 275 are not limited to any specific configuration. For example, the through holes 275 may be respectively a hollow-out area formed on the inflatable body 20.

The supporting pad 81 for use with the face cushion 1 of the fifth preferred embodiment includes a recessed portion 817, a raised portion 818, a secondary hollow-out portion 813, and a cut portion 814. The recessed portion 817 is located adjacent to the raised portion 818, and the secondary hollow-out portion 813 and the cut portion 814 are formed in the recessed portion 817 and communicably connected to each other. The face cushion 1 in use is placed on top of the recessed portion 817 and the raised portion 818 with the hollow-out portion 10 aligned with the secondary hollow-out portion 813. More specifically, the supporting pad 81 is formed of a left pad 815 and a right pad 816 that are arranged side by side, such that the cut portion 814 is formed between the left and the right pad 815, 816; and the recessed portion 817, the raised portion 818 and the secondary hollow-out portion 813 respectively have one half of them formed on the left pad 815 and the other half of them symmetrically formed on the right pad 816. The supporting pad 81 further includes a tubing guide portion 819 and a bottom board 83. The tubing guide portion 819 and the secondary hollow-out portion 813 are located at two opposite ends of the cut portion 814. The bottom board 83 has a plurality of spacers 84 provided thereon to divide the bottom board 83 into a plurality of limiting spaces 85, and the left pad 815 and the right pad 816 are separately disposed in one of the limiting spaces 85 while the tubing of the medical oxygen mask (not shown) is disposed between the two limiting spaces 85.

Please refer to FIGS. 2, 10, 11 and 12. When the patient 70 lies on the medical treatment table 80 in a prone position, the patient's forehead 71 is in contact with the first and the second supporting zones 255, 264 of the face cushion 1. It is noted the first supporting zones 255 and the second supporting zones 264 are arranged alternately and are aligned with the raised portion 818, such that the first and second supporting zones 255, 264 are located between the patient's forehead 71 and the raised portion 818. When the gas supply device 60 supplies the gas 50 to inflate the first and the second supporting zones 255, 264, the first and second supporting zones 255, 264 together with the raised portion 818 can be located at the same height as a height position at which the patient's forehead 71 is set; meanwhile, other parts of the inflatable body 20 together with the recessed portion 817 can be located at the same height as a height position at which the patient's other facial areas are set. With these arrangements, a downward compression generated to the face of the patient 70 lain in the prone position can be evenly distributed on the patient's face to avoid the patient's face from over compression and accordingly, discomfort and pain.

In the fifth preferred embodiment, the inflating connections 40 respectively include two openings 41 and a pipeline 42 located at a corner of the face cushion 1. The openings 41 of one of the two inflating connections 40 are parallelly arranged in the first beginning zone 254, and the openings 41 of the other inflating connection 40 are parallelly arranged in the second beginning zone 263. Each of the pipelines 42 includes two first pipelines 421, a connector 422, and a second pipeline 423. The two first pipelines 421 of each inflating connection 40 are separately connected at one end to the corresponding openings 41 and at the other end to an end of the connector 422; the connector 422 is connected at the other end to the second pipeline 423, which is further connected to the gas supply device 60. When the gas supply device 60 supplies the gas 50 to the inflatable body 20, the gas 50 enters the inflatable body via multiple paths defined by the two sets of first pipelines 421, enabling the face cushion 1 to be quickly inflated with the gas 50.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A face cushion being inflatable with gas supplied from a gas supply device into the face cushion alternately for different parts of a patient's face to contact with the face cushion intermittently, comprising:

a hollow-out portion located at a central portion of the face cushion;

an inflatable body located around an outer side of the hollow-out portion and having an inner peripheral edge that is located adjacent to and surrounds the hollow-out portion, an outer peripheral edge, and two slit edges located between the inner peripheral edge and the outer peripheral edge; an area of the inflatable body located between the inner peripheral edge and the outer peripheral edge being formed into a first air bag and a second air bag; and a part of the first air bag extending around an outer side of the hollow-out portion, and a part of the second air bag extending around an outer side of the first air bag;

a slit section formed between the two slit edges; and a plurality of inflating connections separately connected to the first air bag and the second air bag, and the gas supply device being communicable with the inflating connections of the first air bag and the second air bag via different pipelines to inflate the first air bag and the second air bag alternately at different time points, wherein the inflatable body is formed by connecting two pieces of sheets together along the inner peripheral edge, the outer peripheral edge and the slit edges, the two sheets being further connected to each other along a continuous winding bond line to divide the inflatable body into the first air bag and the second air bag, the continuous winding bond line including an outer line segment located near edges of the inflatable body, an inner line segment located near inner areas of the inflatable body, and a plurality of spacing line segments respectively configured into a reinforcing pattern.

2. The face cushion as claimed in claim 1, further comprising an edge wrapping material that is sewed onto the two sheets along the outer line segment of the continuous winding bond line.

3. The face cushion as claimed in claim 1, wherein the two sheets are further connected to each other along at least one secondary bond line that is not intersected with the continuous winding bond line; and the at least one secondary bond line having a plurality of ends, which are respectively configured into a secondary reinforcing pattern.

4. The face cushion as claimed in claim 1, wherein the continuous winding bond line further encloses a plurality of through holes on the inflatable body, such that the two sheets can be precisely positioned for connecting to each other by aligning corresponding through holes with one another.

5. The face cushion as claimed in claim 1, wherein the hollow-out portion has a T-shaped configuration; the slit section being communicably connected to a longitudinal part of the T-shaped configuration and extending in a direction parallel to a transverse part of the T-shaped configuration.

6. The face cushion as claimed in claim 1, wherein the first air bag includes a first beginning zone that is located corresponding to one of the inflating connections, a first surrounding zone, a plurality of first supporting zones, at least one second surrounding zone and at least one third surrounding zone; and the second air bag includes a second beginning zone that is located corresponding to another one of the inflating connections, a plurality of second supporting zones, at least one fourth surrounding zone, at least one fifth surrounding zone and at least one sixth surrounding zone; and the first supporting zones and the second supporting zones being arranged alternately on the inflatable body at a position configured to correspond to a patient's forehead.

7. The face cushion as claimed in claim 6, wherein the first beginning zone and the second beginning zone are located parallel to each other; the inflating connections separately corresponding to the first and the second beginning zone being spaced on the same side of the face cushion; and the slit section having an outlet located at another side of the face cushion opposite to the side with the inflating connections.

8. The face cushion as claimed in claim 1, wherein the first air bag includes a first surrounding zone, a second surrounding zone and a third surrounding zone, and the second air bag includes a fourth surrounding zone and a fifth surrounding zone; the fourth surrounding zone being located between the first surrounding zone and the fifth surrounding zone, the fifth surrounding zone being located between the fourth surrounding zone and the second surrounding zone, and the second surrounding zone being located between the fifth surrounding zone and the third surrounding zone; and one of the inflating connections being communicably connected to the third surrounding zone while the other one of the inflating connections being communicably connected to the fifth surrounding zone.

9. The face cushion as claimed in claim 1, wherein the face cushion in use is supported on a supporting pad; the supporting pad including a recessed portion, a raised portion, a secondary hollow-out portion and a cut portion; the recessed portion being located adjacent to the raised portion, the secondary hollow-out portion and the cut portion being formed in the recessed portion and communicably connected to each other; and the face cushion in use being placed on top of the recessed portion and the raised portion with the hollow-out portion aligned with the secondary hollow-out portion.

10. The face cushion as claimed in claim 9, wherein the supporting pad is formed of a left pad and a right pad that are arranged side by side; the cut portion being formed between the left and the right pad; and the recessed portion, the raised portion and the secondary hollow-out portion respectively having one half thereof formed on the left pad and the other half thereof symmetrically formed on the right pad.

11. The face cushion as claimed in claim 9, wherein the supporting pad further includes a tubing guide portion; and the tubing guide portion and the secondary hollow-out portion being located at two opposite ends of the cut portion.

12. The face cushion as claimed in claim 9, wherein the first air bag includes a first beginning zone that is located corresponding to one of the inflating connections, a first surrounding zone, a plurality of first supporting zones, at least one second surrounding zone and at least one third surrounding zone; and the second air bag includes a second beginning zone that is located corresponding to another one of the inflating connections, a plurality of second supporting zones, at least one fourth surrounding zone, at least one fifth surrounding zone and at least one sixth surrounding zone; the first supporting zones and the second supporting zones being arranged alternately on the inflatable body at a position configured to correspond to a patient's forehead; and the first supporting zones and the second supporting zones being located in alignment with the raised portion of the supporting pad.

13. A face cushion being inflatable with gas supplied from a gas supply device into the face cushion alternately for different parts of a patient's face to contact with the face cushion intermittently, comprising:

a hollow-out portion located at a central portion of the face cushion;

an inflatable body located around an outer side of the hollow-out portion and having an inner peripheral edge that is located adjacent to and surrounds the hollow-out portion, an outer peripheral edge, and two slit edges located between the inner peripheral edge and the outer peripheral edge; an area of the inflatable body located between the inner peripheral edge and the outer peripheral edge being formed into a first upper air bag, a first lower air bag located in alignment with the first upper air bag, a second upper air bag, and a second lower air bag located in alignment with the second upper air bag; a part of the first upper air bag and a part of the first lower air bag extending around a radially outer side of the hollow-out portion, a part of the second upper air bag extends around a radially outer side of the first upper air bag, and a part of the second lower air bag extends around a radially outer side of the first lower air bag;

a slit section formed between the two slit edges; and a plurality of inflating connections separately connected to the first upper air bag, the first lower air bag, the second upper air bag and the second lower air bag, and the gas supply device being communicable with the inflating connections of the first upper air bag, the first lower air bag, the second upper air bag and the second lower air bag via different pipelines to inflate at least one of the first upper air bag, the first lower air bag, the second upper air bag second lower air bag at different time points.

14. The face cushion as claimed in claim 13, wherein the first upper air bag and the first lower air bag together constitute a first part of the face cushion and the second upper air bag and the second lower air bag together constitute a second part of the face cushion; and wherein the gas supply device provides a first gas supply mode and a second gas supply mode; the gas supply device in the first gas supply mode inflating the first part and the second part alternately for them to reach the same height, and the gas supply device in the second gas supply mode inflating the first part and the second part alternately for them to reach different heights.

15. The face cushion as claimed in claim 13, wherein the inflatable body includes a first sheet, a second sheet, a third sheet and a fourth sheet connected to one another at the inner peripheral edge, the outer peripheral edge and the slit edges; the first sheet being connected to the second sheet, the third sheet being connected to the fourth sheet, and the second sheet being in contact with the third sheet; the first sheet and the second sheet being further connected to each other along a continuous winding bond line to divide the inflatable body into the first upper air bag and the second upper air bag, and the third sheet and the fourth sheet being further connected to each other along another continuous winding bond line to divide the inflatable body into the first lower air bag and the second lower air bag; and the continuous winding bond lines respectively including an outer line segment located near edges of the inflatable body, an inner line segment located near inner areas of the inflatable body, and a plurality of spacing line segments respectively configured into a reinforcing pattern.

* * * * *